United States Patent [19]

Szego

[11] Patent Number: 4,930,651

[45] Date of Patent: Jun. 5, 1990

[54] STORAGE VESSEL FOR LIQUEFIED GAS AT AMBIENT TEMPERATURE

[75] Inventor: Andrew Szego, Willowdale, Canada

[73] Assignee: Explosafe North America Inc., Woodbridge, Canada

[21] Appl. No.: 686,704

[22] Filed: Dec. 27, 1984

Related U.S. Application Data

[63] Continuation of Ser. No. 195,184, Oct. 8, 1980, abandoned, which is a continuation-in-part of Ser. No. 10,420, Feb. 8, 1979, abandoned, which is a continuation-in-part of Ser. No. 888,476, Feb. 20, 1978, abandoned.

[51] Int. Cl.[5] ..... B65D 25/14; B65D 90/04; B65D 90/40

[52] U.S. Cl. ..... 220/88 A; 220/452; 220/900; 220/901

[58] Field of Search ..... 220/88 A, 88 R, 900, 220/901, 452, 71

[56] References Cited

U.S. PATENT DOCUMENTS

| | | | |
|---|---|---|---|
| 1,858,610 | 5/1932 | Bannins, Jr. . | |
| 1,864,990 | 6/1932 | Endsley | 105/358 |
| 1,974,091 | 9/1934 | Wortmann | 220/88 A |
| 2,305,923 | 12/1942 | Held | 220/88 R |
| 2,825,325 | 3/1958 | Ross | 431/344 X |
| 2,850,083 | 9/1958 | Frost . | |
| 2,889,953 | 6/1959 | Morrison | 220/901 X |
| 3,060,962 | 10/1962 | Graves | 137/587 |
| 3,069,042 | 12/1962 | Johnston | 62/45 X |
| 3,085,708 | 4/1963 | Doskev | 220/461 X |
| 3,225,955 | 12/1965 | Forkas et al. | 220/452 X |
| 3,356,256 | 12/1967 | Szego | 220/88 A |
| 3,441,164 | 4/1969 | Wans | 220/71 X |
| 3,561,639 | 2/1971 | Allen . | |
| 3,690,606 | 9/1972 | Pall | 55/526 X |
| 3,804,292 | 4/1974 | Chiti | 220/88 B |
| 4,013,190 | 3/1977 | Wiggins | 220/88 R X |
| 4,200,199 | 4/1980 | Perkins et al. | 220/420 |
| 4,239,416 | 12/1980 | Borca et al. | 220/461 X |

FOREIGN PATENT DOCUMENTS

| | | | |
|---|---|---|---|
| 705745 | 3/1965 | Canada | 220/88 A |
| 3657 | 8/1979 | European Pat. Off. . | |
| 263280 | 3/1912 | Fed. Rep. of Germany | 220/88 A |
| 329822 | 11/1920 | Fed. Rep. of Germany | 220/88 R |
| 601374 | 3/1926 | France | 220/88 A |
| 2231582 | 12/1974 | France | 220/404 |
| 2359767 | 2/1978 | France | 220/88 A |
| 79/1188 | 3/1980 | South Africa . | |
| 531610 | 1/1941 | United Kingdom | 220/88 A |

OTHER PUBLICATIONS

Transcript of Film, *Hazardous Fuel Tank Car Fire Studies*, U.S. Army Material Command, MF 55-5862, 1974.

Anon., Eng. Materials & Design, vol. 19, No. 7, p. 8, Jul. 1975.

*Primary Examiner*—Allan N. Shoap

*Attorney, Agent, or Firm*—Ridout & Maybee

[57] ABSTRACT

Closed pressurized storage vessels for holding liquefied gases and their vapors under high pressure at ambient temperature are provided on the interior surface with a covering of porous heat-conductive material, e.g. heat-conductive expanded metal foil for reducing or avoiding the risk of BLEVE of the vessel on accidental exposure of the vessel to a fire hazard. The filling serves to delay rise in temperature of the wall of the vessel, thus delaying weakening of the wall to the point where it may rupture under the increased internally-generated pressure.

5 Claims, 3 Drawing Sheets

STORAGE VESSEL FOR LIQUEFIED GAS AT AMBIENT TEMPERATURE

This is continuation of my application Ser. No. 195,184 filed Oct. 8, 1980, which is a continuation-in-part of my application Ser. No. 10,420 filed Feb. 8, 1979, which is a continuation-in-part of my application Ser. No. 888,476, filed Mar. 20, 1978 (all now abandoned).

BACKGROUND OF THE INVENTION

The present invention relates to arrangements whereby the hazards of so-called "boiling liquid expanding vapor explosion" (which is referred to herein by the initials BLEVE) may be reduced or avoided. More particularly, the present invention is concerned with measures for the protection of closed storage vessels for the storage of liquefied gases at ambient temperature. Examples include large scale storage vessels for the storage of non-flammable liquefied gases such as liquefied inert gases, e.g. the FREONS and other inert volatile aerosol propellant liquids and refrigerants, liquefied petroleum gas, liquefied ammonia and liquefied propane. The invention is, however, in general applicable to the protection of all closed storage vessels for liquefied gases having their critical temperature above normal ambient temperature whether flammable or non-flammable where the wall structure of the vessel is capable of withstanding a significant internal pressure. Such vessels will typically have pressure-resistant walls adapted to withstand internal pressures of at least 200 p.s.i.g., more typically at least 400 p.s.i.g. All such storage vessels are liable to the said explosive failure of enormously destructive capability, termed a BLEVE, on accidental exposure to a fire hazard or other source of heating impinging on the exterior of the vessel.

As a result of the application of heat, a pressure is built up within the vessel. If the flame or other heating is initially incident on an area of the vessel below the liquid level, the heat will initially be dissipated through the liquefied gas boiling, so that the internal pressure increases. If the vessel has a pressure-relief valve, once a certain preset pressure limit is reached, vapor will be released through actuation of the pressure-relief valve. However, since the conventional pressure relief valves vent through a restricted opening, the rate of heat flow and of boiling-off vapor may rapidly overwhelm the capacities of the pressure-relief valve so that an internal pressure greatly in excess of the preset pressure limit may be achieved. Once sufficient liquid has evaporated, and the liquid level has dropped, that region of the wall of the vessel that is now above the liquid level will become rapidly hotter, and the tensile strength of the metal or other material constituting the wall of the vessel in this region will be locally weakened to a point where the vessel wall ruptures explosively under the internal pressure that has built up within the vessel.

A serious problem associated with the BLEVE is that following the initial accident that results in an outbreak of fire, there is a period of unpredictable duration, before the heating is sufficient to weaken the metal skin to the point where the pressure vessel ruptures.

Up to the present invention, there has been no satisfactory way of preventing or adequately deferring the occurrence of a BLEVE.

Proposals have been made to coat the exterior of railroad tank cars and the like with insulative thermal shields in an attempt to resolve explosion problems. The difficulty with the exterior coatings is that they are likely to be broken off or destroyed as a result of impact while leaving the metal wall of the tank intact. Thus, under the conditions in which the tank cars are most likely to be exposed to a heating hazard, i.e., through collision or derailment, the tank wall is liable to be left intact and exposed to a heating hazard, e.g., to burning gases escaping from an adjacent damaged tank, thus exposing the intact tank to risk of explosive rupture.

It is known to employ explosion-suppressive inserts of reticulated plastic foam or of expanded aluminum foil in fuel tanks which in service contain explosively ignitable mixtures of fuel vapor and air. It is known that these inserts reduce the transient rise in pressure which occurs within the container when the combustible mixture is ignited, so that the resulting rise in pressure, termed the "overpressure", is insufficient to burst or yield the wall of the container. An example of a reticulated plastic foam inert material is described in Allen U.S. Pat. No. 3,561,639, and an expanded aluminum foil insert is described in Szego U.S. Pat. No. 3,356,256.

The above explosion-suppressive inserts have been used in tanks which contain an explosively combustible fuel vapor/air mixture. They have not been employed in pressurised liquefied petroleum gas storage vessels or other storage vessels containing ambient temperature pressurised liquids which are stable when heated.

SUMMARY OF THE INVENTION

It has therefore been found most surprisingly that an internal covering of a flame-permeable, heat-resistant, heat-conductive, porous material, such as the expanded aluminum foil material, when maintained in thermal contact with the wall of a closed ambient temperature liquefied gas storage vessel, and extending into the liquefied gas contained in the vessel, will not only at least defer considerably but also in many cases will entirely prevent the wall of the vessel increasing in temperature to a point at which its tensile strength is insufficient to withstand the internal vapor pressure, so that rupture of the tank when exposed to heating from the exterior can be significantly delayed or can be prevented.

The porous material employed in the vessels of the invention is a flame-permeable material i.e. it has interstices sufficiently large to permit propagation of flame through it, so that, in contrast to flame arrestor materials, flame-permeable materials permit the propagation of a flame front through them when they are exposed to an ignited combustible air and vapor mixture. The use of porous materials of large pore size has the advantage that it provides enhanced heat transfer as compared with fine-pored flame arrestor materials, as hot vapors can pass more freely through the porous material so that convective cooling, in which hot vapors move away from a locally-heated area and are replaced by cooler vapor, can occur to a greater degree.

One especially preferred form of porous material comprises a plurality of layers of expanded metal foil, a mesh, netting or lattice of expanded thin aluminum foil as described in U.S. Pat. No. 4,149,649 dated Apr. 17, 1979 in the name of A. Szego or the above-mentioned in U.S. Pat. No. 3,356,256 in the name J. Szego dated Dec. 6, 1967, especially with reference to FIG. 9 of the latter patent. This material which has prior to the present invention been employed to suppress explosive combustion of inflammable vapor mixtures, is available under the trade mark EXPLOSAFE from Explosafe American Inc., of, Toronto, Ontario, Canada. This material is formed from a plurality of layers, each comprising a layer of expanded metal foil consisting of interconnected flat mesh strands which are each inclined at the same angle to the general plane of the layer, and which define between them diamond shaped openings. As commercially available, this material has pores or interstices of relatively large size and is flame-permeable. The aluminum foil is flame and heat resistant, and is relatively light in weight, and due to its porosity, it does not interfere with the free flow of liquefied gas into, out of, or through the vessel or with free evolution of vapor from the surface of liquid during the normal use of the storage vessel.

Typically the widths of the strands forming said expanded aluminum foil may be from 1/32 to 7/32 of an inch, and advantageously in the range 1/32 to ⅛ inch, and the foil thickness is preferably in the range of from about 0.0005 to 0.012 inches, more typically about 0.001 to 0.010 inches and preferably about 0.001 to 0.005 inches. When layers of the expanded foil are laid together to form a mass the interstices of the mesh provide open passageways through which the liquids contained in the vessel can flow freely, and because of its highly expanded state, the metal mesh does not significantly detract from the volumetric capacity of the interior of the vessel. Typically, the mesh occupies less than about 2 percent and usually between about 1.8% and 1.9% of the bounded volume it occupies in the interior of the vessel. The packing density of the mesh within the vessel will typically be from about 1 to 5 lbs per cu. ft., more usually 2 to 4 lbs. per cu. ft. and preferably about 3 to 4 lbs. per cu. ft.

Similar porous, heat-resistant, and heat-conductive materials that may be employed include materials of honeycomb sandwich construction, e.g. the metal homeycomb materials available under the trade mark HEXCEL, from Hexcel Corporation, Dublin, Calif., and knitted wire mesh products as available under the trade mark METEX from Metex Corporation, Edison, N.J.

One advantage of the flame-permeable materials is that they are normally of comparatively low density as compared with flame arrestor materials and they are somewhat less expensive than the flame arrestor materials, as well as being easier to support within the storage vessel.

BRIEF DESCRIPTION OF THE DRAWINGS

The present invention will now be more fully described, by way of example only, with reference to the accompanying drawings, wherein.

DESCRIPTION OF THE PREFERRED EMBODIMENTS

Figure 1:
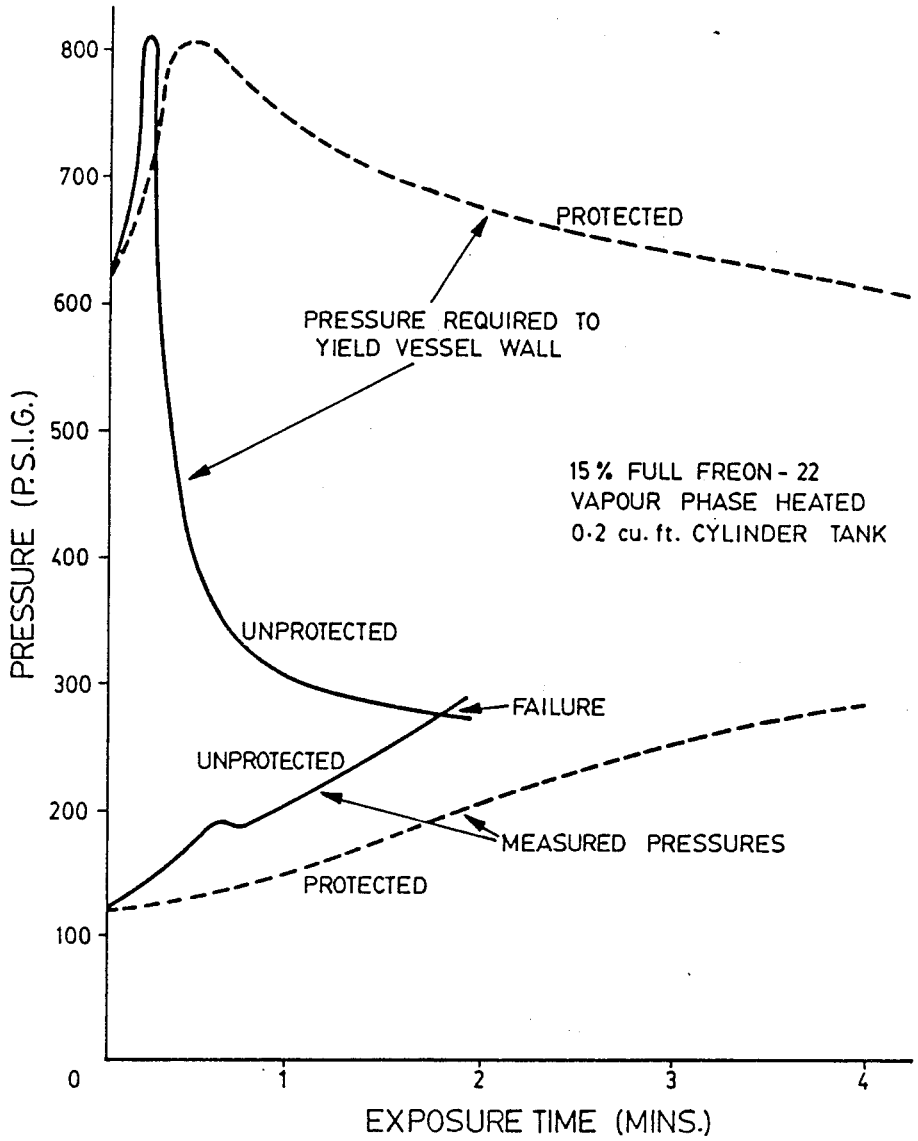
FIG. 1 shows a graph plotting internal pressures generated within a pressure vessel exposed to a heating source and also plotting the pressure required to rupture the vessel, calculated from the variation in tensile strength of the wall material with the rise in temperature of the wall.
Figure 2:
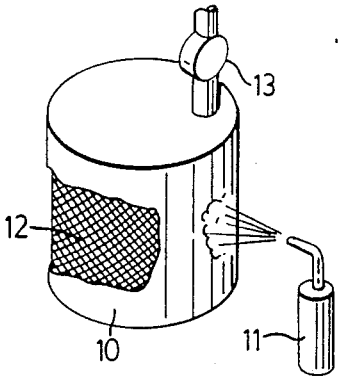
FIG. 2 shows a fragmentary perspective view of a tank containing a filler mass of expanded aluminum foil material.

In the examples from which the data illustrated in the graph of FIG. 1 were obtained, 0.2 cu. ft. cylindrical tanks were employed as shown in FIG. 2. The tanks had a carbon steel pressure-resistant tank wall 10. The tanks were filled to an extent of 15% of its volume with liquid FREON-22, and were equipped with thermo couples to measure the wall temperature, and with an internal pressure measuring device.

In the tests the tanks were exposed to an external heat source provided by a propane/air blow torch 11 illustrated in diagrammatic form in FIG. 2.

Results plotted in the graph in broken lines and labelled "Protected", are applicable to tanks filled with an internal filler mass 12 of EXPLOSAFE expanded aluminum foil material.

The testing was also conducted with identical tanks containing no filler mass. The results are indicated in the solid lines in the graph, labelled "Unprotected".

From the measured wall temperatures, the tensile strengths of the wall material at these temperatures was obtained from standard tables, and the pressures required to burst the wall were obtained therefrom. The results are shown in the upper plots in the graph and indicate the weakening of the tank wall 10 with increasing temperature on continued exposure. The lower plots are of the measured pressure values, and indicate the rise in internal pressure.

It will be noted from FIG. 1 that the strength of the tank wall 10 initially, at ambient temperature, is sufficient to withstand an internal pressure of about 610 p.s.i.g. and that in the unprotected condition, the burst strength of the wall falls to about 300 p.s.i.g. within about 1 minute from the time heating of the tank wall commences. With the protected tank the burst strength of the tank wall does not drop to near 600 p.s.i.g. until near the end of the test period. The tanks under test were provided with a pressure relief valve as indicated at 13 in FIG. 2. The valve was set to vent at 275 p.s.i.g. and therefore pressures above that value in the graph are obtained by extrapolation. It may be seen, however, that with the unprotected tank a point of failure, at which the pressure generated is sufficient to rupture the weakened tank wall, would be obtained after about 1.8 mins. exposure to the heating, while with the protected tank a rupture point is not reached during the period of test.

In the practice of the invention, the pressure vessels that may be protected will typically be storage vessels of large capacity that are adapted to withstand an internal pressure of at least 200 p.s.i.g., more typically 400 to 1000 p.s.i.g. In order to conduct heat away from the surface of the protected vessel, and defer or prevent a hazardous rise in temperature of the vessel wall, the vessels need not be completely filled throughout their interior volume with the expanded metal mesh material or other open-texture heat-conductive material, and a protection can be obtained by covering the inner surface of the vessel. In order to economise on the amount of open-texture material employed and on the weight added to a vessel, it may be desired to apply the interior convering only at those areas that are especially liable to impingement of flame or other heat hazard in the event of an accidental outbreak of fire. Thus, in the case of a railway tank car or other vessel where there is little likelihood of flame impinging on the bottom or lower surface of the vessel, the interior covering may be applied only on the side and top interior surfaces of the wall of the vessel. For convenience, or in order to provide a firm and secure positioning and support of the mesh material inside the vessel, it may however be preferable to completely fill the interior of the vessel, so that there are substantially no interior voids.

On exposure of the vessel to a fire hazard, where the flame impinging on the vessel is below the level of the liquid inside the vessel, in the case of a vessel protected in accordance with the invention, at least initially heat may be dissipated through the liquid inside the vessel vaporising and through vaporised liquid venting through the pressure-relief valve conventionally provided as a safety measure on pressurised storage vessels.

When the liquid level in the tank has fallen as a result of evaporation, or if the tank is initially mostly empty, the area of the tank wall on which the heat and flame impinges may lie above the surface of the liquid within the tank, and in such case heat will no longer be absorbed through vaporisation of the liquid, but with the vessel in accordance with the invention rise in temperature of the vessel wall to its yield point can be delayed at least until the liquefied gas has vented from the vessel and its internal pressure equalizes with the surroundings, so that rupture of the vessel is prevented.

In the case of the unprotected vessel, however, the heating effect will rapidly reduce the strength of the wall to a point where the BLEVE will occur.

Figure 3:
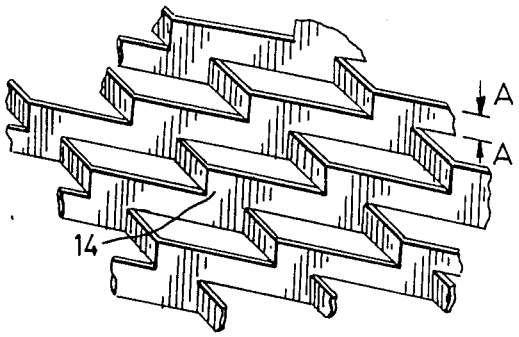
FIG. 3 shows a perspective view of a piece of expanded foil material.
Figure 4:
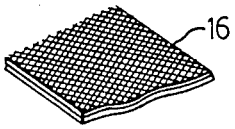
FIG. 4 shows a perspective view of a multiple-layer assembly of pieces of expanded metal foil.

As one preferred example of filling material may be mentioned a foil mesh material e.g. as illustrated in FIG. 3 obtained from aluminum foil 14 of 0.003 inch thickness, which is slit through a rotary-slitting procedure and is expanded in accordance with the procedures described in U.S. Pat. No. 4,144,624 dated Mar. 20, 1979 in the names A. Szego et al. The mesh strand width i.e. the dimension A—A in FIG. 3 is 0.055 inches and the expansion of the slit foil is from an original slit and unexpanded width of 14 inches to an unexpanded width of 39 inches. Pieces of this expanded metal foil, which is obtained in sheet form, are laid one on top of another to form a multiple-layer mass. Preferred procedures for forming the multiple-layer masses, for example coiling the foil material to form a coiled roll conforming to the interior surfaces of the tank, are described in the above-mentioned U.S. Pat. No. 4,149,649 in the name A. Szego, to which reference may be made for further details. A multiple-layer mass of the material is indicated at 16 in FIG. 4. These masses constitute the filler material 12 used to fill the tanks of FIG. 2. Typically, the packing density of the expanded foil within the vessel approximates to 3 lbs. per cu. ft.

Figure 5:
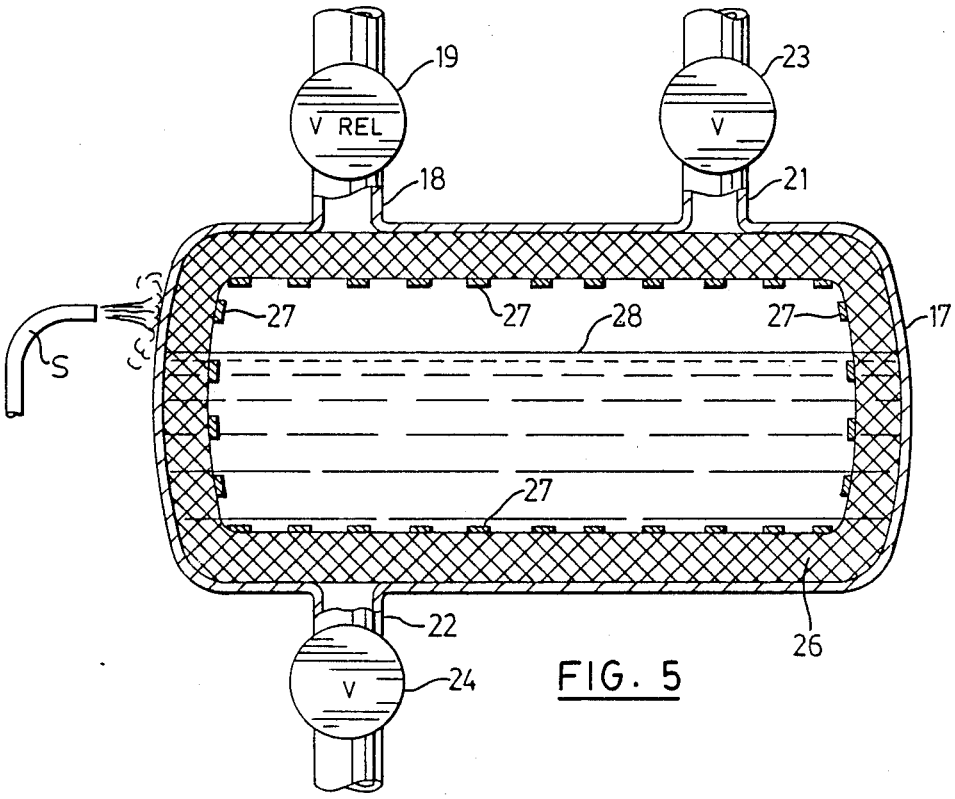
FIG. 5 shows a view partly in vertical section, and partly in diagrammatic form, of a tank for holding liquefied gases equipped with a protective interior surface covering.

FIG. 5 illustrates a further example of a generally cylindrical tank for holding liquefied gas under high pressure at ambient temperature, having a metallic wall 17 and an outlet port 18 equipped with a pressure-relief valve 19 set to vent to the atmosphere through a restricted valve opening if the internal pressure rises above a predetermined limit below the internal pressure that the wall of the vessel is adapted to withstand at ambient temperature. In the case of vessels that are adapted to withstand maximum internal pressures of 400 to 1000 p.s.i.g., the relief valve may typically be adapted to vent the vessel when the internal pressure rises to a predetermined pressure below said maximum pressure, in the range 100 to 900 p.s.i.g. The tank is further provided with ports 21 and 22 in its upper and lower sides equipped with flow-control valves 23 and 24 through which in use gas, i.e., vaporised liquefied gas, or liquid, i.e., liquefied gas, can be withdrawn from the tank, or through which liquid can be charged into the tank.

Figure 6:
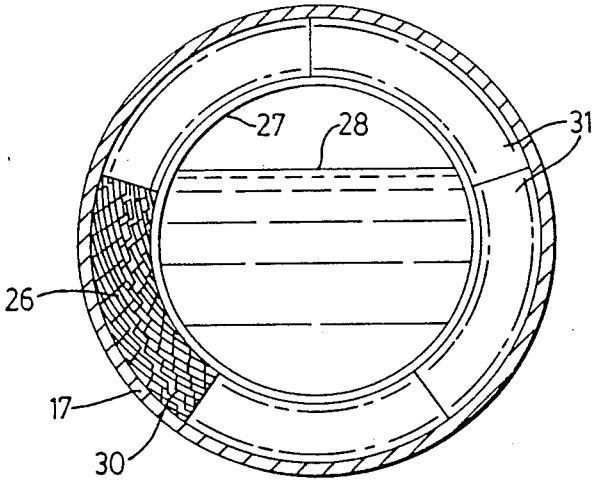
FIG. 6 shows a transverse section through the tank of FIG. 5.

In this example the entire interior surface of the tank wall 17 is covered with a thick blanket-like lining of layers of open-texture expanded aluminum foil 26 laid together face to face. Advantageously, this is the EXPLOSAFE (trade mark) expanded aluminum foil material referred to earlier. There should be good thermal contact between the lining 26 and the metal of the wall 17. It has been found that the orientation of the layers of expanded metal foil is an important consideration. Testing has shown that if each layer of the expanded metal foil is arranged parallel to the adjacent tank wall, this configuration is more effective in conducting heat away from the wall and into the liquefied gas within the tank, than those configurations in which the layers of foil run perpendicular to the tank wall. Thus, as shown in FIG. 6 the layers 30 of expanded metal foil constituting the lining 26 should be laid one on top of another parallel to the adjacent wall so that the lining consists wholly of layers 30, each of which is parallel to the adjacent wall of the vessel. When the expanded metal foil is laid up to form multiple-layer batts of 2 to 10 inches thickness, the resulting batts are deformable by hand pressure so that as shown in FIG. 6, these batts 31 may be curved to conform to the curvature of the cylindrical wall 17. At the ends of the tank, the lining 26 may similarly be formed of batts which are shaped by hand pressure to conform them to the walls of the tank, these batts being trimmed to a shape matching the circular ends of the tank. Alternatively, the lining 26 may be built up from relatively small individual block-like units of multiple-layer material cut from a larger multiple-layer bale of EXPLOSAFE material, and the blocks may be fitted together to form a coherent and continuous lining, much in the same fashion as a refractory block lining for a furnace, with the layers of the foil in each block extending parallel with the adjacent metal wall 17.

As the layers of EXPLOSAFE material form a resilient porous mass, they may be readily held in tight abutment with the interior surface of the wall 17 employing a resilient cage structure, which, as will be appreciated from FIG. 5, may comprise spaced, discrete elongated resilient members 27 forming a network, or some other convenient arrangement of resilient members exerting resilient pressure on the lining 26 so that this is pressed outwardly toward the wall 17 so that there is a good thermal contact between the lining and the wall 17 and in order to counteract the tendency of the wall 17 to retreat outwardly from the lining 26 when the tank expands when it is heated. The cage 27 defines an empty void within the tank 17 completely surrounded by the lining 26.

In the example illustrated in FIGS. 5 and 6, it will be seen that the volume of the void defined by the inner surface of the cylindrical lining 26 comprises a major portion of the total volume of the tank.

The thickness of the lining that is required to satisfactorily disperse heating incident of the exterior of the tank 17 depends on the bulk thermal conductivity properties of the porous material that is employed. Typically the thickness of the lining will be at least about 2 inches. In the case of the EXPLOSAFE expanded foil product referred to above, the thickness may be in the range 2 to 20 inches. It has been found that EXPLOSAFE expanded foil linings of about 2 to 10 inches in thickness normally give satisfactory BLEVE-delaying action and therefore more preferably the lining 26 is about 2 to 10 inches in thickness.

When flame or some other source of heating is incident on an area of the tank wall from a heat source S, as shown in FIG. 5, where the heat is incident on an area above the liquid level 28 the lining 26 can conduct the heat laterally into the body of the liquid 28 and into portions of the lining remote from the area at which the heat is incident.

As the lining 26 is pervious with respect to the liquid, as indicated by the liquid level in FIG. 5 extending through the lining, the lining does not interfere with free flow of the liquid or its vapor into and out of the tank, and does not substantially reduce the volumetric capacity of the tank.

As examples of vessels to which the porous material coverings described in detail may be applied, there can be mentioned pressurized tank cars, for rail and road transport, and stationary storage vessels, especially large capacity storage vessels for the storage of liquefied petroleum gases. These liquefied petroleum gases generate quite high super atmospheric vapor pressures even at relatively low temperatures. For example at 27° C. the vapor pressure of liquid propane is 10 atmospheres and at 58° C. the corresponding pressure is 20 atmospheres. Liquid butane exhibits a vapor pressure of 2 atmospheres at 19° C. and of 5 atmospheres at 50° C. Examples of other liquefied gases that may be stored in the storage vessels will include inert, non-flammable liquids such as FREONS i.e. halogenated lower alkanes including chlorinated, brominated and/or fluorinated methanes, ethanes, and butanes; as well as other aerosol propellant liquids; liquefied inert gases, and the like.

I claim:

1. A storage vessel resistant to rupture of its wall, said vessel being closed and containing at ambient temperature and superatmospheric pressure a liquefied gas that remains stable at elevated temperature and exerts an increasing vapor pressure with increasing temperature, and having at least on a selected area of the interior surface of its wall that is exposed to a heating hazard an interior covering of a flame permeable, heat-resistant, heat-conductive porous material in thermal contact with the wall of the vessel and extending into the liquefied gas in the vessel and delaying increase in temperature of the wall when exposed to a heat source located exteriorly of the vessel, whereby rupture of the wall of the vessel is deferred or prevented, wherein said covering extends as a lining over the entire interior surface of the vessel wall, and wherein said lining surrounds and encloses an empty volume in the central region of the vessel.

2. A vessel as claimed in claim 1 wherein the lining is 2 to 20 inches in thickness.

3. A vessel as claimed in claim 1 wherein said lining is 2 to 10 inches in thickness.

4. A vessel as claimed in claim 1 wherein the empty volume comprises a major portion of the volume bounded by the outer surface of the lining.

5. A vessel as claimed in claim 1 including a cage comprising spaced, discrete elongated resilient members forming a network disposed on the inner surface of the lining and resiliently urging the lining outwardly into contact with the inner surface of the vessel wall.

* * * * *